United States Patent [19]

Förg

[11] 4,112,700

[45] Sep. 12, 1978

[54] LIQUEFACTION OF NATURAL GAS

[75] Inventor: Wolfgang Förg, Icking, Germany

[73] Assignee: Linde Aktiengesellschaft, Wiesbaden, Germany

[21] Appl. No.: 597,093

[22] Filed: Jul. 18, 1975

[30] Foreign Application Priority Data

Aug. 9, 1974 [DE] Fed. Rep. of Germany ..... 2438443

[51] Int. Cl.[2] ..... F25J 3/02

[52] U.S. Cl. ..... 62/28; 62/40

[58] Field of Search ..... 62/40, 335, 28, 23, 62/9

[56] References Cited

U.S. PATENT DOCUMENTS

| | | | |
|---|---|---|---|
| 3,315,477 | 4/1967 | Carr | 62/40 |
| 3,418,819 | 12/1968 | Grunberg et al. | 62/40 |
| 3,596,472 | 8/1971 | Streich | 62/40 |
| 3,763,658 | 10/1973 | Gaumer, Jr. et al. | 62/40 |
| 3,964,891 | 6/1976 | Krieger | 62/40 |

FOREIGN PATENT DOCUMENTS

| | | | |
|---|---|---|---|
| 2,242,998 | 3/1974 | Fed. Rep. of Germany | 62/40 |
| 895,094 | 5/1962 | United Kingdom | 62/40 |

*Primary Examiner*—Hiram H. Bernstein
*Attorney, Agent, or Firm*—Millen & White

[57] ABSTRACT

Process for the liquefaction of natural gas by heat exchange, initially with a first multicomponent mixture and thereafter with a second multicomponent mixture, each of these mixtures, respectively in a closed refrigeration cycle, being compressed, at least partially liquefied, and expanded, characterized in that the first multicomponent mixture, after the partial liquefaction thereof, is subjected to a phase separation; that the thus-obtained liquid fraction, after its expansion, is at least partially evaporated in heat exchange with media to be cooled comprising the natural gas, the gaseous fraction obtained during the phase separation, and the second multicomponent mixture; and that the gaseous fraction, liquefied in heat exchange with the expanded liquid fraction, is expanded and at least partially evaporated in heat exchange with the natural gas and with the second multicomponent mixture, which latter is at least partially liquefied during this heat exchange.

15 Claims, 5 Drawing Figures

LIQUEFACTION OF NATURAL GAS

BACKGROUND OF THE INVENTION

This invention relates to a process for the liquefaction of natural gas by heat exchange initially with a first multicomponent mixture and thereafter with a second multicomponent mixture, each of these mixtures being compressed, at least partially liquefied, and expanded in separate closed refrigeration cycles.

A process for the liquefaction of natural gas is known wherein the natural gas is precooled in heat exchange with a first multicomponent mixture containing several low boiling hydrocarbons and thereupon is liquefied in heat exchange with a second multicomponent mixture different from the first but likewise containing hydrocarbons. Each multicomponent mixture, in a closed cycle, is compressed, liquefied, expanded, and evaporated against the natural gas. The liquefaction of the first multicomponent mixture takes place in heat exchange with cooling water, whereas the second mixture is liquefied in heat exchange with the first mixture ("TRANS. INSTN. CHEM. ENGRS." Vol. 35, 1957, p. 86). A substantial disadvantage of this known process resides in its high energy consumption. Another disadvantage is that because the mixtures are each evaporated in individual heat exchangers, it is also difficult to attain a sufficient temperature stabilization in the individual heat exchangers.

SUMMARY OF THE INVENTION

An object of this invention is to develop a thermodynamically efficient process for the liquefaction of natural gas.

Another object is to provide a temperature-stabel process.

Upon further study of the specification and appended claims, further objects and advantages of this invention will become apparent to those skilled in the art.

To attain these objects, a system is provided comprising subjecting the first multicomponent mixture, after its partial liquefaction, to a phase separation step to obtain a first multicomponent gaseous fraction and a first multicomponent liquid fraction; expanding resultant first multicomponent liquid fraction, and at least partially evaporating at least a portion of the thus-expanded liquid fraction in indirect heat exchange relationship with (a) the natural gas to cool same, (b) said first multicomponent gaseous fraction to liquefy same, and (c) the second multicomponent mixture; and expanding resultant liquefied first multicomponent gaseous fraction, and at least partially evaporating resultant expanded liquefied first multicomponent gaseous fraction in indirect heat exchange with the cooled natural gas and the second multicomponent mixture, the latter being at least partially liquefied during this heat exchange.

The process of this invention is very advantageous from an energy viewpoint, i.e. by the separate evaporation of the fractions obtained during the phase separation of the partially condensed first multicomponent mixture there is obtained a close relationship between the heating curve of the multicomponent mixture to the cooling curve of the natural gas in the precooling range. In addition, satisfactory temperature stabilization is reached in the heat exchangers, inasmuch as in the phase separation of the first multicomponent mixture within the cycle, separate liquids are evaporated in the respective heat exchangers: one liquid enriched with the higher-boiling component of the multicomponent mixture, this being propane for example in case of the use of an ethane-propane mixture, and another liquid enriched with the lower-boiling component, i.e. ethane.

Advantageously, the evaporation of the liquid fraction produced during the phase separation of the first multicomponent mixture is conducted in several stages, i.e. under decreasing pressures and thus also decreasing temperatures; in this connection, according to a further feature, the liquid fraction is subjected to a phase separation step after each expansion step. A portion of the liquid formed during a phase separation step is evaporated under the existing pressure in heat exchange with the natural gas and with the second multicomponent mixture and is thereupon fed, together with the "flash gas" obtained during the expansion, to the corresponding compression stage of the cycle compressor, while the remainder of the liquid is further expanded and likewise subjected to a phase separation. This procedure is repeated until the last expansion stage has been reached. It has been found that, by this technique, excellent temperature stabilization is attained within the heat exchangers since despite the use of a multicomponent mixture as the cycle medium, an almost pure propane fraction is evaporated in the first heat exchangers of the plant. The gaseous fraction obtained during the phase separation of the multicomponent mixture which, when using an ethane-propane mixture, is very greatly enriched with ethane, yields sufficient cold at such a low temperature level that it is possible to extensively liquefy the second multicomponent mixture which advantageously contains nitrogen, methane, ethane, and propane, and this proves to be very favorable from a thermodynamic viewpoint.

If the natural gas, during the course of the cooling step, is subjected to a preliminary fractionation during which ethane and higher hydrocarbons are separated, the head cooling of the preliminary fractionation column takes place in heat exchange with the gaseous fraction formed during the phase separation of the first multicomponent mixture. Since this fraction makes cold available at a sufficiently low temperature level, a substantial separation of the natural gas is possible within the preliminary fractionation column, with a high yield of ethane, propane, and higher-boiling hydrocarbons.

It is preferred for the first multicomponent mixture to consist essentially of, by volume, 8 to 20% $C_2$ and 92 to 80% $C_3$ and for the second multicomponent mixture to consist essentially of, by volume, 3 to 12% nitrogen, and 33 to 45% $C_1$, 45 to 55% $C_2$ and 3 to 6% $C_3$ hydrocarbons.

DETAILED DESCRIPTION OF THE DRAWINGS

Figure 1:
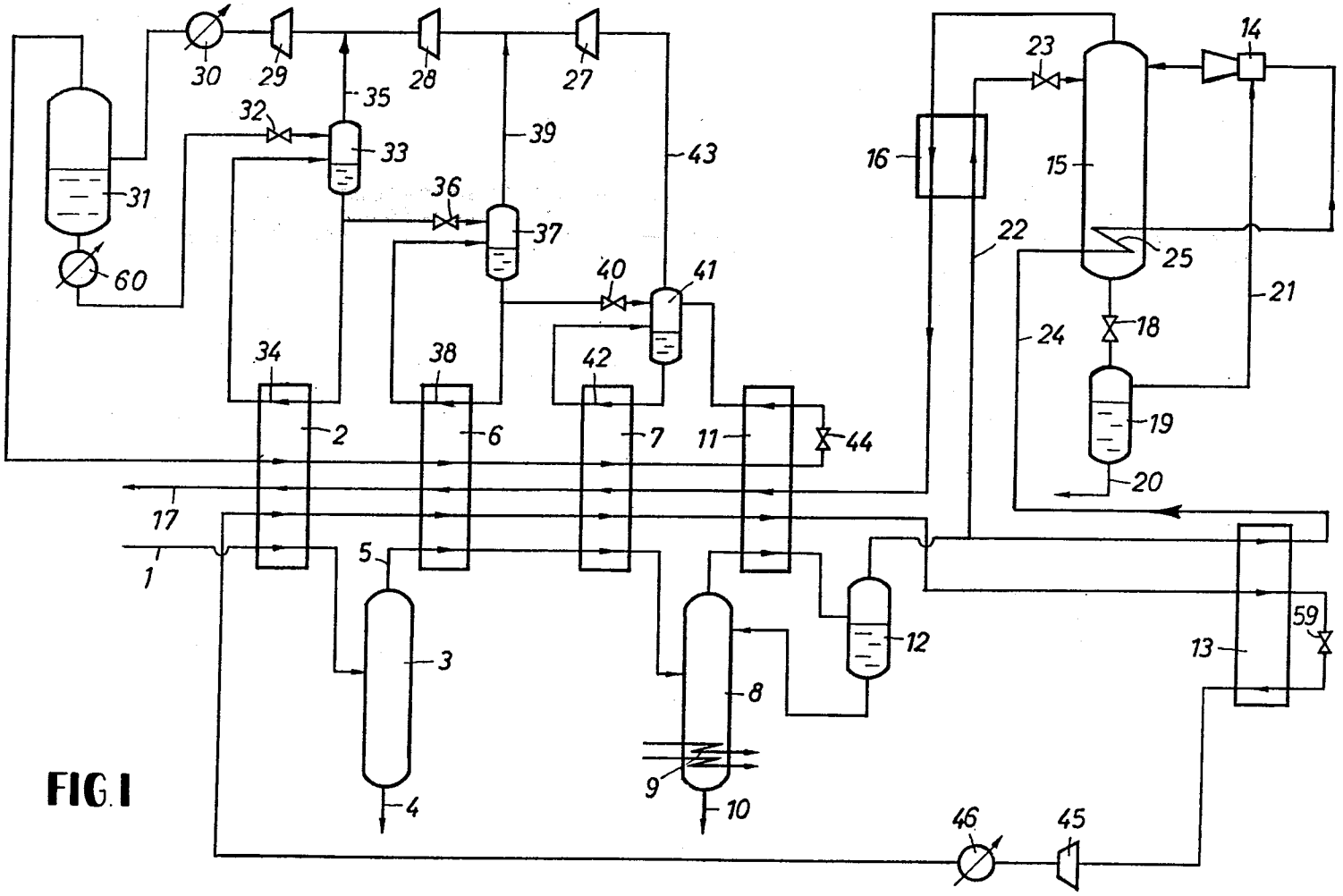
FIGS. 1 – 5 illustrate preferred embodiments schematically, identical reference numerals being provided for the same parts of the system.

According to FIG. 1, natural gas to be liquefied consisting in this example essentially of by volume 6% nitrogen, 83.5% methane, 7% ethane, 2.2% propane, and 1.3% higher-boiling hydrocarbons, is fed to the plant via a conduit 1 under a pressure of about 44 atmospheres absolute. A first cooling of the natural gas is conducted in heat exchanger 2, whereby higher hydrocarbons of five and more carbon atoms and water are condensed. These hydrocarbons and the thus-condensed water are separated from the natural gas in a phase separator 3 and discharged from the plant via a conduit 4. The remaining natural gas is first completely dried and withdrawn from the device 3 via a conduit 5, further cooled and partially condensed in the heat exchangers 6 and 7, and thereupon fed into a rectifying column 8. In the sump of the column 8, heated by means of a heater 9, a liquid is obtained as the sump product which contains almost exclusively on a mol basis 25.7% ethane, 31.2% propane, and 43.1% higher-boiling hydrocarbons. This sump product is fed via a conduit 10 to a processing plant, not shown herein, where the individual components of the sump product are obtained in an almost pure state and thus are available for covering the leakage losses in the mixture cycles which will be described below.

The gaseous head product of column 8, consisting essentially only of by volume 6.2% nitrogen, 85.0% methane, and 6.8% ethane, as well as minor amounts of propane and butane at this point, is partially condensed in the heat exchanger 11 and subjected to a phase separation in the separator 12. While the liquid fraction obtained during the phase separation is refluxed into column 8, a part of the gaseous fraction is liquefied and subcooled in the heat exchanger 13. Thereupon, this latter fraction is passed via conduit 24 to reboiler 25 of a second rectifying column 15, and from there is expanded in ejector 14 before being injected into the head of said rectifying column 15 and subjected to a nitrogen separation step. The nitrogen-rich head product of column 15 containing by volume 40.4% nitrogen and 59.6% methane, is first warmed in a heat exchanger 16 and then in the heat exchangers 11, 7, 6 and 2, and discharged from the plant via a conduit 17, for example as fuel gas. The rectifying column 15 is operated under a slight excess pressure just sufficient to compensate for the pressure drop of the head product in the individual heat exchanger cross sections.

The liquid sump product of column 15, consisting essentially of methane, is expanded via a valve 18 into a further separator or storage tank 19, which is under approximately atmospheric pressure, and withdrawn from the plant via a conduit 20. The vapor obtained in the separator or storage tank 19, composed substantially of flash gas, is fed via a conduit 21 to the intake side of the ejector 14 and therein again compressed to the operating pressure of the column 15. In this way it is possible to make available to the plant also the cold of the vapor obtained in separator 19 without the use of an additional expensive refrigerating blower which otherwise would also entail the loss of a portion of the refrigeration from the process.

The cold of the nitrogen-rich head product of column 15, produced at a maximally low temperature, is advantageously transferred to a portion of the natural gas to be liquefied. For this purpose, part, e.g. about 2 to 4%, of the gaseous fraction obtained in separator 12 is branched via a conduit 22, liquefied in heat exchanger 16 against the cold head product of column 15, and then expanded into column 15 via a valve 23. The main portion of the gaseous fraction obtained in the separator 12 is passed through heat exchanger via a conduit 24 in heat exchanger 25 while heating the sump of column 15, and thereupon expanded into column 15 via ejector 14.

If the natural gas to be liquefied contains only a very small quantity of nitrogen, e.g. less than 3% by volume, or none at all, so that an additional nitrogen separation can be omitted, it is possible to replace the column 15 by a simple separator, with the process otherwise being conducted in the same way.

The cold required for effecting the process is made available by two mixture cycles connected in cascade fashion.

The refrigerant of the first mixture cycle, serving essentially for precooling purposes, is a mixture of about by volume 10.2% ethane and the remainder propane. This refrigerant is compressed in the compression stages 27, 28 and 29 of the cycle compressor to the final cycle pressure of about 12 to 15 atmospheres absolute, partially condensed in the water cooler 30, and subjected to a phase separation in the separator 31. The liquid fraction obtained in the separator 31, which is strongly enriched, e.g. about at least 91.6 molar percent, with propane, is subjected to intermediate expansion to a pressure of about 7.7 atmospheres absolute, after further being cooled in the water cooler 60, by being passed via a valve 32 into a first separator 33. A portion of the liquid fraction obtained in the separator 33, which contains about at least 93.6 molar percent propane, is evaporated in the cross section 34 of heat exchanger 2, recycled into the separator 33, and then fed via a conduit 35 to the third compression stage 29 together with the vapor formed during the expansion.

The remainder of the liquid fraction obtained in the separator 33 is further expanded via a valve 36 to a pressure of about 2.9 atmospheres absolute into a second separator 37. A portion of the liquid fraction produced in separator 37 is then evaporated in the cross section 38 of heat exchanger 6, recycled into the separator 37, and thereafter fed via conduit 39 to the second compression stage 28, together with the vapor obtained during the expansion.

The remainder of the liquid fraction formed in separator 37 is finally expanded via a valve 40 into a third separator 41 to the lowest pressure of the cycle, e.g. about 1.1 atmospheres absolute. The liquid fraction obtained in separator 41 is evaporated in the cross section 42 of the heat exchanger 7, recycled into the separator 41, and then fed to the first compression stage 27 by way of a conduit 43, together with the vapor formed during the expansion.

The multistage expansion and evaporation at different pressure levels, to which the liquid fraction obtained in separator 31 is subjected, is very advantageous from an energy viewpoint, since this results in a very good fit of the heating curve of the refrigerant to the cooling curve of the natural gas. By the provision of the separators 33, 37, and 41, a disadvantage is positively avoided with certainty such that unvaporized refrigerant cannot be passed into the compression stages, which could lead to a destruction of the compressors. A further decisive advantage of providing the separator 31 and also the separators 33, 37 and 41, however, resides in that almost pure propane is evaporated in the heat exchanger cross sections 34, 38 and 42, despite the use of a multicomponent mixture cycle. This factor is of paramount importance in order to obtain temperature stabilization in heat exchangers 2, 6 and 7.

The gaseous fraction produced in the separator 31 is liquefied and subcooled in heat exchangers 2, 6, 7, expanded in valve 44, and evaporated in heat exchanger 11 against the head product of column 8 and the second multicomponent mixture cycle. Thereupon, the fraction is first fed to the separator 41 and subsequently via the conduit 43 to the first compression stage 27 of the cycle compressor. Optionally, the gaseous fraction, prior to its expansion in valve 44, can be still further subcooled in heat exchange with itself in the heat exchanger 11.

Since the gaseous fraction formed in separator 31 contains on a volume percent basis about 23% ethane and 77% propane, cold can be transferred in heat exchanger 11 at a relatively low temperature level. This affords the advantage, on the one hand, that a relatively large portion of the head product of column 8 is condensed in heat exchanger 11, so that a large amount of reflux can be generated for this column. By virtue of this reflux, it is possible to strip out methane so extensively that the sump product is substantially devoid of same, thereby eliminating the requirements for additional methane separation capacity in the separating unit (not shown) provided for processing the components of the high-boiling sump product. In addition, by the use of a mixture of ethane and propane in heat exchanger 11, it is possible to liquefy a large portion, e.g. 67 to 78% of the multicomponent mixture of the second multicomponent mixture cycle, which is thermodynamically very advantageous.

The treatment of the first multicomponent mixture cycle in accordance with this invention thus yields two decisive advantages: on the one hand, it is possible despite the use of a multicomponent mixture to stabilize the temperatures in the heat exchangers 2, 6 and 7, and on the other hand, sufficient cold can be generated at a sufficiently low temperature level so that, on the one hand, an effective preliminary separation of the components of the natural gas can be conducted, and on the other hand, the second multicomponent mixture can also be substantially liquefied.

The multicomponent mixture of the second mixture cycle which is utilized to transfer cold for the complete liquefaction and subcooling of the natural gas, consists essentially of on a volumetric basis, about 11.5% nitrogen, 34.5% methane, 50.0% ethane and 4.0% propane. This mixture is compressed in the cycle compressor 45 to the cycle pressure of about 40 to 45 atmospheres absolute and cooled in the water cooler 46. Thereupon, the mixture is partially liquefied in the heat exchangers 2, 6, 7 and 11 in heat exchange against the refrigerant of the first mixture cycle. In the heat exchanger 13, the multicomponent mixture is entirely liquefied and subcooled. Finally, the mixture is expanded in valve 59 to about a pressure of 3 to 5 atmospheres absolute, evaporated in heat exchanger 13 against (a) natural gas (the latter being thereby liquefied and subcooled) and (b) against itself, and recycled to the intake of cycle compressor 45. The special advantage of the second mixture cycle resides in its simplicity, since for the liquefaction and subcooling of the natural gas only a single heat exchanger, namely heat exchanger 13, with only three cross sections, is required, so that a wound heat exchanger can be readily utilized. Furthermore, the second multicomponent mixture cycle requires hardly any buffer volume in the apparatus, so that the power of a turbocompressor as the cycle compressor 45 is not impaired by density fluctuations of the cycle gas.

Figure 2:
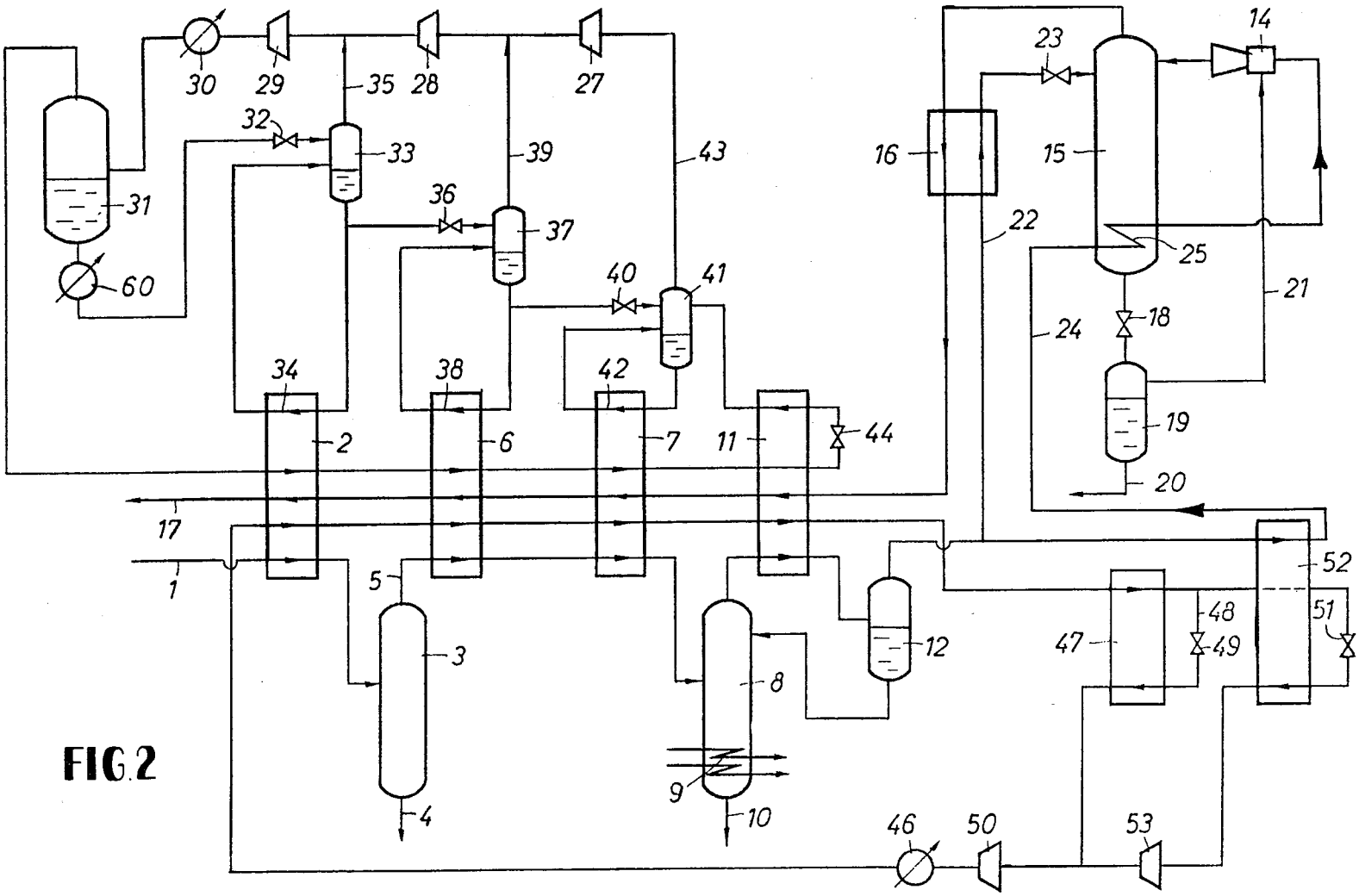

The system of FIG. 2 differs from the embodiment shown in FIG. 1 essentially only by the treatment of the second multicomponent mixture cycle. According to FIG. 2, the second multicomponent mixture partially liquefied in heat exchangers 2, 6, 7 and optionally 11 is completely liquefied and subcooled in a heat exchanger 47. The liquefying and subcooling steps are conducted by heat exchange with a partial stream of the second multicomponent mixture branched off via a conduit 48, expanded to an intermediate pressure, about 2.8 to 6 atmospheres absolute, in valve 49, and evaporated in heat exchanger 47. Thereupon, the partial stream which has been expanded to the intermediate pressure is fed to the second compression stage 50 of the cycle compressor. The subcooled remaining stream of the second multicomponent mixture is expanded to a lower pressure about 1.8 to 2.8 atmospheres absolute in valve 51 and evaporated in heat exchanger 52 against natural gas, the latter being liquefied and subcooled during this heat exchange. The resultant evaporated mixture is fed to the first compression stage 53 of the cycle compressor. It is also contemplated that the remaining stream, prior to its expansion in valve 51, can be still further subcooled in heat exchanger 52 in heat exchange against itself in the expanded state.

The advantage of this treatment of the second multicomponent mixture cycle resides in a lower energy requirement, but this advantage must be balanced against a somewhat increased expenditure for the apparatus. All other process features illustrated in FIG. 2 are the same as those of FIG. 1.

Figure 3:
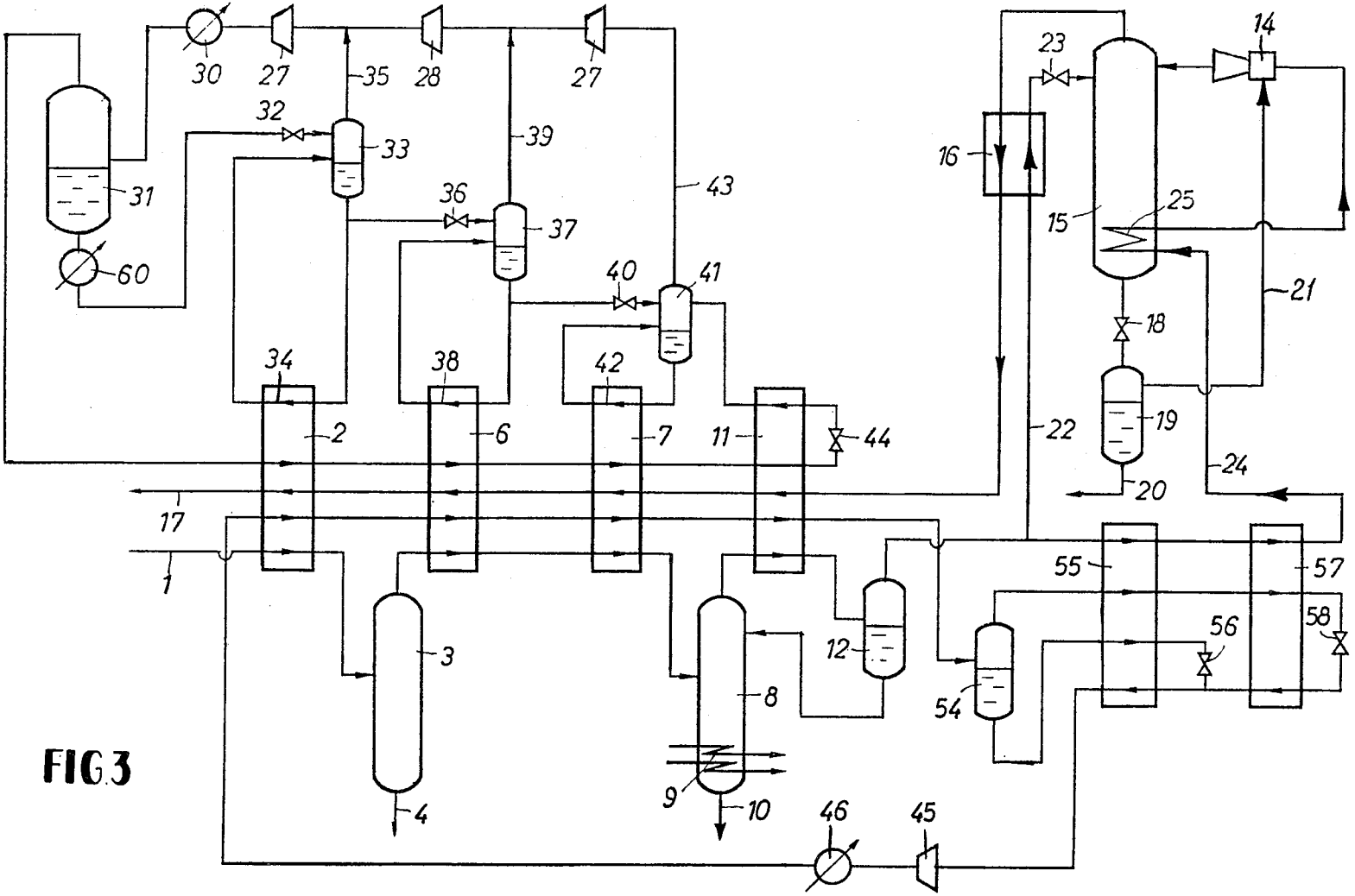
Figure 4:
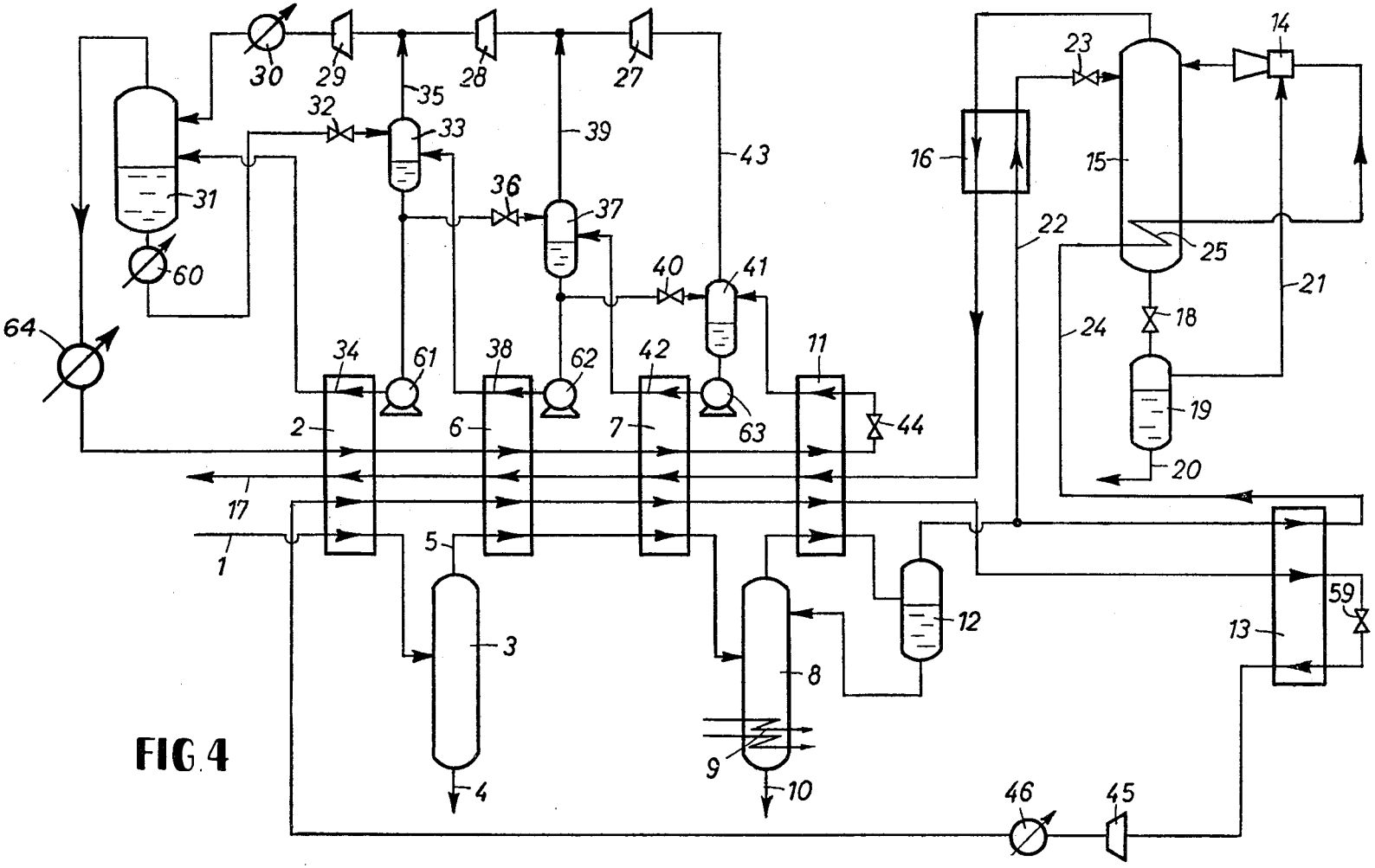
Figure 5:
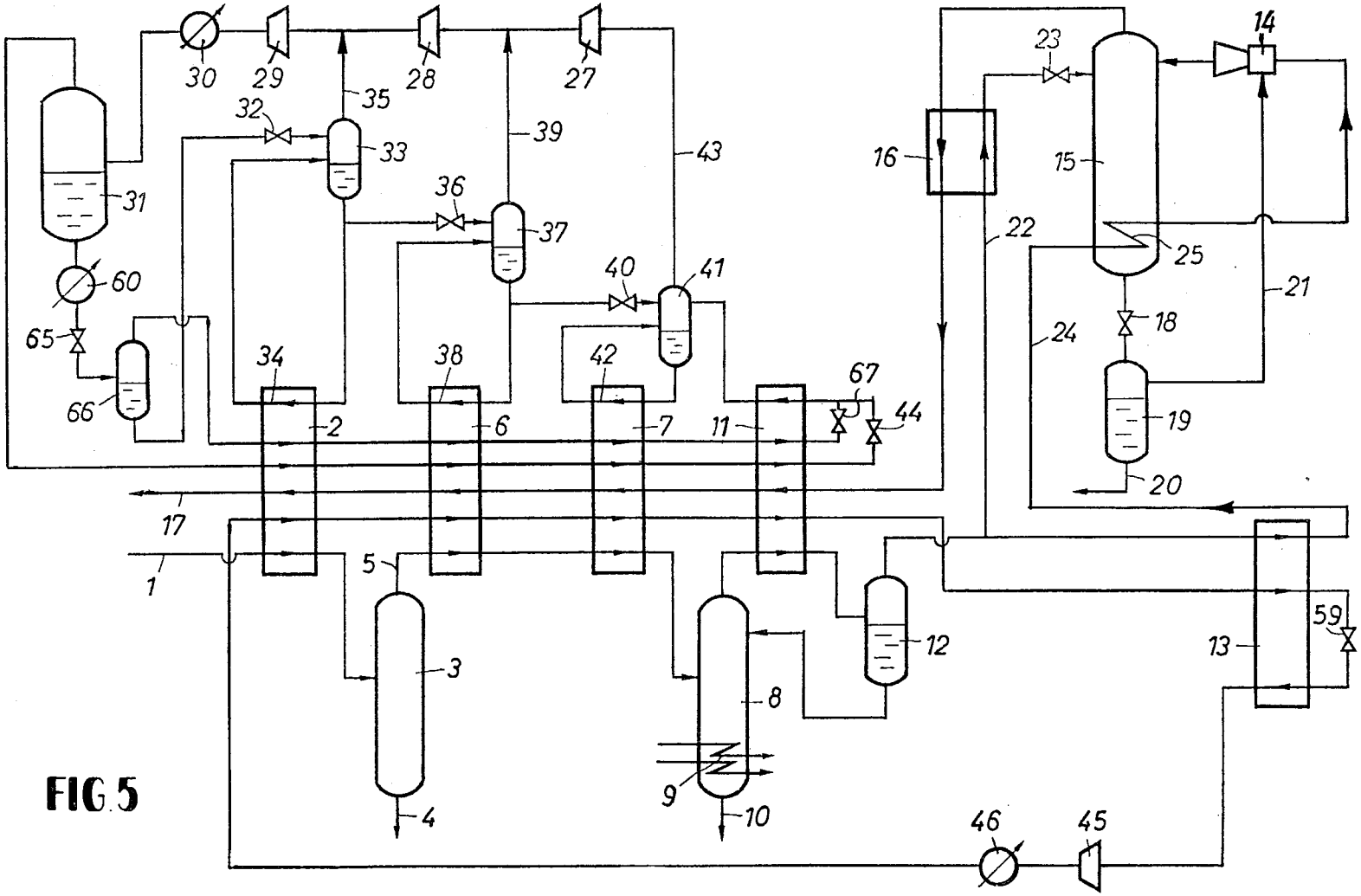

Another advantageous system for the treatment of the second multicomponent mixture is shown in FIG. 3. According to this figure, the second multicomponent mixture, partially condensed in heat exchangers 2, 6, 7 and 11, is subjected to a phase separation in separator 54. The liquid fraction obtained in separator 54 is subcooled in heat exchanger 55, expanded in valve 56, and evaporated in heat exchanger 53 against (a) liquefying natural gas, (b) the liquefying gaseous fraction from separator 54, and (c) itself. The resultant liquefied gaseous fraction is subcooled in heat exchanger 57, expanded in valve 58, and evaporated in heat exchanger 57 against subcooling natural gas and against itself. Thereupon, both fractions are combined and again fed to the cycle compressor 45. This embodiment of the second mixture cycle is also relatively advantageous from an energy viewpoint. In FIGS. 4 and 5, further advantageous embodiments of this invention are illustrated, which differ from the previous ones by the treatment of the first mixture cycle. The treatment of the second multicomponent mixture cycle for the low-temperature cooling of the natural gas corresponds to that of FIG. 1, but it is likewise possible to employ the second multicomponent mixture cycle in FIG. 4 as well as FIG. 5 in accordance with those of FIGS. 2 and 3, respectively.

According to FIG. 4, the ethane-propane mixture of the first mixture cycle is compressed in compression stages 27, 28 and 29, just as in the previous embodiments, then partially condensed in the water cooler 30, and subjected to a phase separation in separator 31. The propane-rich liquid fraction is further cooled in the water cooler 60 and subjected to an intermediate expansion by passing it via the valve 32 into the first separator 33. A portion, e.g. 20 to 35%, of the thus-formed liquid fraction is recompressed, without raising the temperature, by means of a pump 61 to the final pressure of the cycle, warmed and evaporated under this pressure in the cross section 34 of heat exchanger 2, and then recycled into the separator 31. The remainder of the liquid fraction obtained in separator 33 is further expanded, via the valve 36, into the second separator 37. A portion, e.g. 30 to 40% of the liquid fraction obtained in separator 37 is compressed by means of a pump 62 to the pressure of the first separator 33, warmed and evaporated in the cross section 38 of the heat exchanger 6, and recycled thereafter into the separator 33. The remainder of the liquid fraction obtained in separator 37 is expanded into the last separator 41 via the valve 30. The liquid fraction produced in separator 41 is compressed by means of the pump 63 to the pressure of the second separator 37, warmed and evaporated in the cross section 42 of heat exchanger 7, and then recycled into the second separator 37. The gaseous fractions obtained in the separators 33, 37 and 41 are fed via conduits 35, 39 and 43 directly to the corresponding compression stages 29, 28 and 27 of the cycle compressor.

The gaseous fraction formed in the separator 31 is first cooled, liquefied, and subcooled by heat exchange in water cooler 64 and heat exchanger 2, 6, 7 and 11, and is thereafter expanded in valve 44, and then evaporated in heat exchanger 11 against (a) natural gas, (b) the second multicomponent mixture cycle, and (c) itself. Thereafter, the resultant evaporated fraction is fed to the first compression stage 27 of the cycle compressor via the separator 41 and the conduit 43.

By the intermediate compression of the liquid fractions obtained in separators 33, 37, and 41 in pumps 61, 62, and 63, the sensible heat of these liquid fractions can be efficiently utilized in the process. Additionally, inasmuch as part of the cycle gas is compressed while it is in the liquid state, a further savings in energy is obtained.

The embodiment of FIG. 5 differs from that of FIG. 1 likewise by the treatment of the first multicomponent mixture cycle. According to FIG. 5, the liquid fraction obtained in separator 31 is subjected, after passing through the water cooler 60, to an intermediate expansion in valve 65 to a pressure of about 8 to 12 atmospheres absolute and exposed to a further phase separation in separator 66. The further treatment of the liquid fraction obtained in separator 66 is executed analogously to the embodiment of FIG. 1. The gaseous fraction formed in separator 66 is liquefied and subcooled, just as the gaseous fraction obtained in separator 31, in the heat exchangers 2, 6, 7 and 11 and thereupon expanded in valve 67. This expanded liquid is then joined with the fraction from separator 31 and expanded in valve 44, and evaporated in heat exchanger 11 against (a) natural gas, (b) the second multicomponent mixture, and (c) itslef and recycled via the separator 41, to the first compression stage 27 of the cycle compressor.

The additional expansion to intermediate pressure in valve 65 and the phase separation in separator 66 affords the advantage that the liquid fraction obtained in the separator 66 is substantially pure propane, whereby an excellent temperature stability is ensured in the heat exchangers 3, 6 and 7 where this fraction is evaporated.

In a process for the liquefaction of natural gas, in which the cold required for the process is made available by two cycles connected in cascade fashion, the energy consumption is low, if in the first cycle a temperature between −50° C. and −55° C. is reached. These temperatures can easily be achieved with a mixture of ethane and propane as refrigerant of the first cycle. Furthermore, it is possible to liquefy a great part of the second multicomponent refrigerant in heat exchange with the first multicomponent mixture. This is very advantageous and results in a higher refrigerating capacity per unit quantity of refrigerant of the second cycle.

Normally the multicomponent mixtures exist of components which are present in natural gas. This lowers the costs to produce make up fluid required to effect leakage losses. But from a thermodynamic viewpoint it is also possible to use propylene and ethylene instead of propane and ethane. Other possible components that may be present in the multicomponent refrigerants are halogenated hydrocarbons.

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. In a process for the liquefaction of natural gas by heat exchange, initially with a precooling first multicomponent mixture and thereafter with a deep cooling second multicomponent mixture, each of these mixtures being in separate closed refrigeration cycles, being compressed, at least partially liquefied, and expanded, wherein the improvement comprises the first multicomponent mixture consisting essentially of by volume 8 to 20% $C_2$ and 92 to 80% $C_3$ hydrocarbons, subjecting the first multicomponent mixture, after its partial liquefaction, to a phase separation step to obtain a first milticomponent gaseous fraction and a first multicomponent liquid fraction; expanding resultant first multicomponent liquid fraction, and at least partially evaporating at least a portion of the thus-expanded liquid fraction in indirect heat exchange relationship with (a) the natural gas to cool same, (b) said first multicomponent gaseous fraction to cool same, and (c) the second multicomponent mixture to cool same; subjecting another portion of said thus-expanded liquid fraction to at least one further expansion, and at least partially evaporating at least a portion of the thus further expanded liquid fraction in indirect heat exchange relationship with (a) the natural gas to cool same, (b) said first multicomponent gaseous fraction to at least partially liquefy same, and (c) the second multicomponent mixture to cool same; and expanding resultant liquefied first multicomponent gaseous fraction, and at least partially evaporating resultant expanded liquefied first multicomponent gaseous fraction in indirect heat exchange with the cooled natural gas and the second multicomponent mixture, the latter being at least partially liquefied during this heat exchange, completely liquefying at least a part of the resultant at least partially liquefied second muticomponent mixture, expanding resultant completely liquefied second multicomponent mixture and evaporating resultant expanded second multicomponent mixture in indirect heat exchange with (a) said at least part of the resultant at least partially liquefied second multicomponent mixture to completely liquefy the latter and with (b) the natural gas previously cooled by the first multicomponent mixture so as to liquefy at least part of the aforesaid natural gas.

2. A process according to claim 1, wherein the fractions obtained during the phase separation step are subcooled prior to expansion.

3. A process according to claim 1, wherein the expansion of the first multicomponent liquid fraction obtained during the phase separation step is conducted in several stages.

4. A process according to claim 3, wherein the liquid fraction is subjected to a phase separation step after each expansion step, and the liquid fraction produced during each phase separation is evaporated, in part, in heat exchange with (a) natural gas, (b) said first multicomponent gaseous fraction and (c) the second multicomponent mixture and, the remainder of the liquid fraction is fed to the next following expansion stage.

5. A process according to claim 4, wherein the liquid fractions obtained after the expansion steps are compressed, prior to the heat exchange thereof with (a), (b) and (c) to the pressure of the preceding expansion step.

6. A process according to claim 1, wherein that the first multicomponent mixture consists essentially by volume of 8 to 20% ethane and 92 to 80% propane, and the second multicomponent mixture consists essentially of 3 to 12 volume % nitrogen and of 33 to 45% $C_1$, 45 to 55% $C_2$ and 3 to 6% $C_3$ hydrocarbons.

7. A process according to claim 1, wherein the second multicomponent mixture, at least partially liquefied against the first multicomponent mixture, is completely liquefied, then expanded, and is then evaporated in heat exchange with the natural gas and with itself.

8. A process according to claim 1, wherein in that the second multicomponent mixture, at least partially liquefied against the first multicomponent mixture, is completely liquefied and subcooled in heat exchange with a partial liquid fraction of itself expanded to an intermediate pressure; and the remaining fraction is expanded to a lower pressure than said intermediate pressure and is evaporated in heat exchange with the natural gas.

9. A process according to claim 1, wherein the partially liquefied second multicomponent mixture is subjected to a phase separation; resultant separated liquid fraction is subcooled, expanded, and evaporated in heat exchange with natural gas, with itself, and with resultant separated gaseous fraction, the latter being liquefied, and the resultant liquefied gaseous fraction is subcooled, expanded, and evaporated in heat exchange with the natural gas and with itself.

10. A process according to claim 1, wherein the natural gas is partially liquefied in heat exchange with the liquid fraction obtained during the phase separation of the first multicomponent mixture, and is preliminarily separated in a first rectifying column; and the gaseous fraction obtained in the head of said first rectifying column is partially liquefied in heat exchange with the gaseous fraction obtained during the phase separation of the first multicomponent mixture; resultant partially liquefied natural gas is subjected to a phase separation, passing resultant separated liquid fraction of natural gas back as reflux to the first rectifying column; and passing at least a portion of the gaseous fraction of natural gas obtained during the phase separation in heat exchange with the second multicomponent mixture to liquefy and subcool the natural gas.

11. A process according to claim 10, wherein the natural gas, after liquefaction is expanded through an ejector into a second rectifying column; expanding the sump product of said second rectifying column to approximately atmospheric pressure to obtain a flash gas, and passing said flash gas to the suction side of the ejector.

12. A process according to claim 11, wherein a portion of the gaseous fraction obtained during the phase separation of the head product of the first rectifying column is liquefied in heat exchange with the head product of the second rectifying column and is expanded into said second column.

13. A process according to claim 11, wherein a portion of the gaseous fraction obtained during the phase separation of the head product of the first rectifying column is liquefied in heat exchange with the sump of the second rectifying column and is expanded into the upper zone of said second column.

14. A process according to claim 12, wherein a portion of the gaseous fraction obtained during the phase separation of the heat product of the first rectifying column is liquefied in heat exchange with the sump of the second rectifying column and is expanded into the upper zone of said second column.

15. A process according to claim 1 wherein the first multicomponent mixture is about 10.2% by volume ethane and the remainder propane.

* * * * *